US006026254A

United States Patent [19]

Gon

[11] Patent Number: 6,026,254

[45] Date of Patent: Feb. 15, 2000

[54] IMAGE FORMING APPARATUS THAT CAN OPERATE DURING MALFUNCTION

[75] Inventor: Shoukou Gon, Toyohashi, Japan

[73] Assignee: Minolta Co., Ltd., Osaka, Japan

[21] Appl. No.: 09/016,293

[22] Filed: Jan. 30, 1998

[30] Foreign Application Priority Data

Jan. 31, 1997 [JP] Japan ..... 9-018481

[51] Int. Cl.[7] ..... G03G 15/00; G03G 21/00

[52] U.S. Cl. ..... 399/38; 399/9; 399/81

[58] Field of Search ..... 399/81, 38, 43, 399/44, 47, 53, 9

[56] References Cited

U.S. PATENT DOCUMENTS 4,839,698 6/1989 Inuzuka et al. .
4,870,459 9/1989 Ito et al. .
4,922,296 5/1990 Kasuya et al. .
5,049,938 9/1991 Ueda .
5,146,269 9/1992 Shimizu et al. .
5,539,499 7/1996 Fujisawa .
5,754,576 5/1998 Kusano et al. ..... 372/38

FOREIGN PATENT DOCUMENTS 5-53388 5/1993 Japan .

*Primary Examiner*—Richard Moses
*Attorney, Agent, or Firm*—McDermott, Will & Emery

[57] ABSTRACT

In image forming apparatus pertaining to the present invention, after a malfunction is detected, the control of the image forming apparatus is carried out while isolating the malfunctioning device from said control, so that the image forming operation can be performed. It is determined whether a condition governing continued image forming exists during said isolating control. If said certain condition does not exist, the image forming operation is allowed to continue. Where said certain condition does exist, the image forming operation is suspended and subsequent image forming operations are prohibited, or a maintenance call request is displayed.

36 Claims, 6 Drawing Sheets

IMAGE FORMING APPARATUS THAT CAN OPERATE DURING MALFUNCTION

This application is based on application No. 9-18481 filed in Japan, the content of which is hereby incorporated by reference.

BACKGROUND OF THE INVENTION

1. Field of the Invention

The present invention pertains to an image forming apparatus such as a printer or facsimile machine, and more particularly to the control when a malfunction occurs in the image forming apparatus.

2. Description of the Related Art

It is conventionally known that there are two types of problems and malfunctions that occur in an image forming apparatus: one comprises malfunctions that do not directly affect the image forming operation, such that image formation may be continued (indirect malfunctions), and the other comprises malfunctions that affect the image forming operation such that image formation cannot be continued (direct malfunctions). It is known that, in the case of an indirect malfunction, the image forming operation may be carried out by stopping the functions of the unit experiencing the malfunction and using the remaining units only. On the other hand, where a direct malfunction occurs, the image forming operation is immediately suspended.

The applicant has observed, however, that even in the case of a direct malfunction, there are cases where the image forming operation may be performed without affecting image performance or apparatus performance so long as prescribed conditions exist. For example, where the motor that rotates the toner bottle experiences a problem, although the supply of toner to the developing device will stop, so long as there is toner remaining inside the developing device, image forming operation may be continued until the toner inside the developing device has been consumed.

However, in a conventional image forming apparatus, when the malfunction in the motor is detected, the operation of the developing device is immediately stopped because normal toner supply is no longer available. This leads to immediate cessation of the image forming operation as well. Thus, conventional image forming apparatuses have the problem of a low operation rate because the image forming operation is suspended based on the detection of a malfunction that does not immediately affect the image forming operation.

SUMMARY OF THE INVENTION

The object of the present invention is to provide an image forming apparatus with a high operation rate and reduced down time by increasing the range in which image forming operation may be continued by, when a malfunction is detected, isolating the device in which the malfunction has occurred and performing control under a prescribed condition.

In order to attain this object, the image forming apparatus of the first aspect of the present invention is equipped with a detecting means that detects malfunctions in devices that are contained in the image forming apparatus, a first control means that permits the image forming operation without using the device which is detected to have a malfunction by said detector, a condition determining means that determines whether or not a prescribed condition exists after the detection of a malfunction by said detecting means, and a warning means that warns of an abnormal condition of the image forming apparatus when it is determined by said condition determining means that said prescribed condition exists. Said prescribed condition is, for example, a condition that affects the image forming operation in connection with the function of the device detected to have the malfunction. After the occurrence of said malfunction, it is determined, while the malfunction is still present, whether or not this condition exists.

In addition, in connection with the isolation control by said first control means, the time period before image forming operation is prohibited may be prolonged, i.e., the down time may be reduced, by substituting the function of the device that was made unusable or reducing the burden on the apparatus due to the malfunction.

The second aspect of the present invention pertains to an image forming apparatus control method to (i) detect a malfunction in any of the devices that are contained in the image forming apparatus, (ii) permit performance of the image forming operation when the malfunction is detected on the condition that isolating the device detected to have the malfunction from the control, (iii) determine whether or not a prescribed condition exists after the malfunction is detected, and (iv) warn of an abnormal condition of the image forming apparatus when it is determined that said prescribed condition exists.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
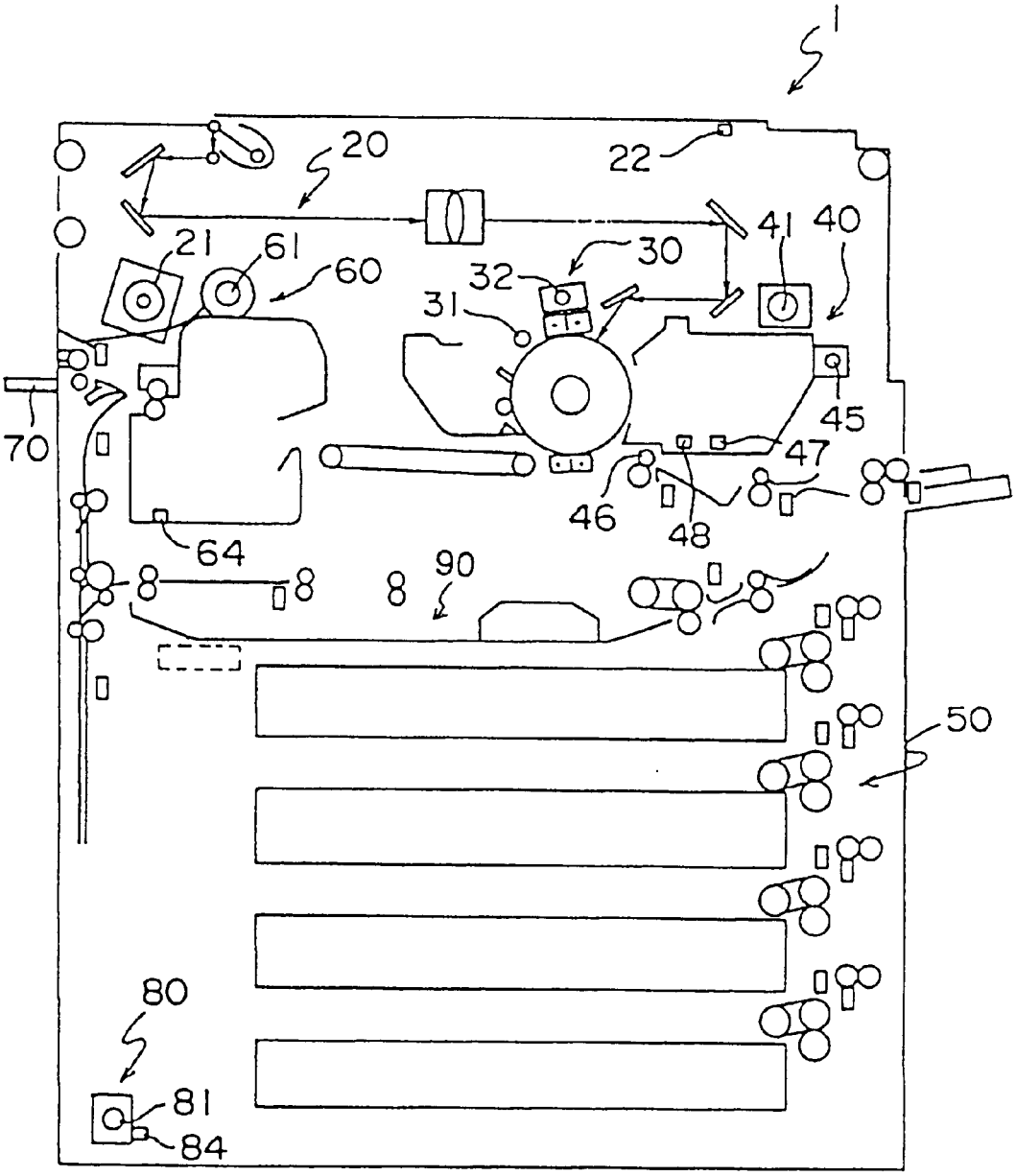
FIG. 1 is a cross-sectional view of a copying machine pertaining to the present invention.

FIG. 1 shows copying machine 1, an image forming apparatus pertaining to the present invention. This copying machine 1 forms an electrostatic latent image by means of photoreceptor unit 30 based on the image read by optical unit 20. The electrostatic latent image is developed into a toner image by means of developer unit 40. The toner image is transferred to a sheet of paper supplied from one of the cassettes of paper feeder 50 and fused onto the paper by means of fusing unit 60. The sheet of paper on which the image is formed is then ejected toward eject tray 70. In the case of two-sided copying, the paper is housed temporarily in two-sided copy unit 90 and then undergoes image formation on the other side before it is ejected.

Figure 2:
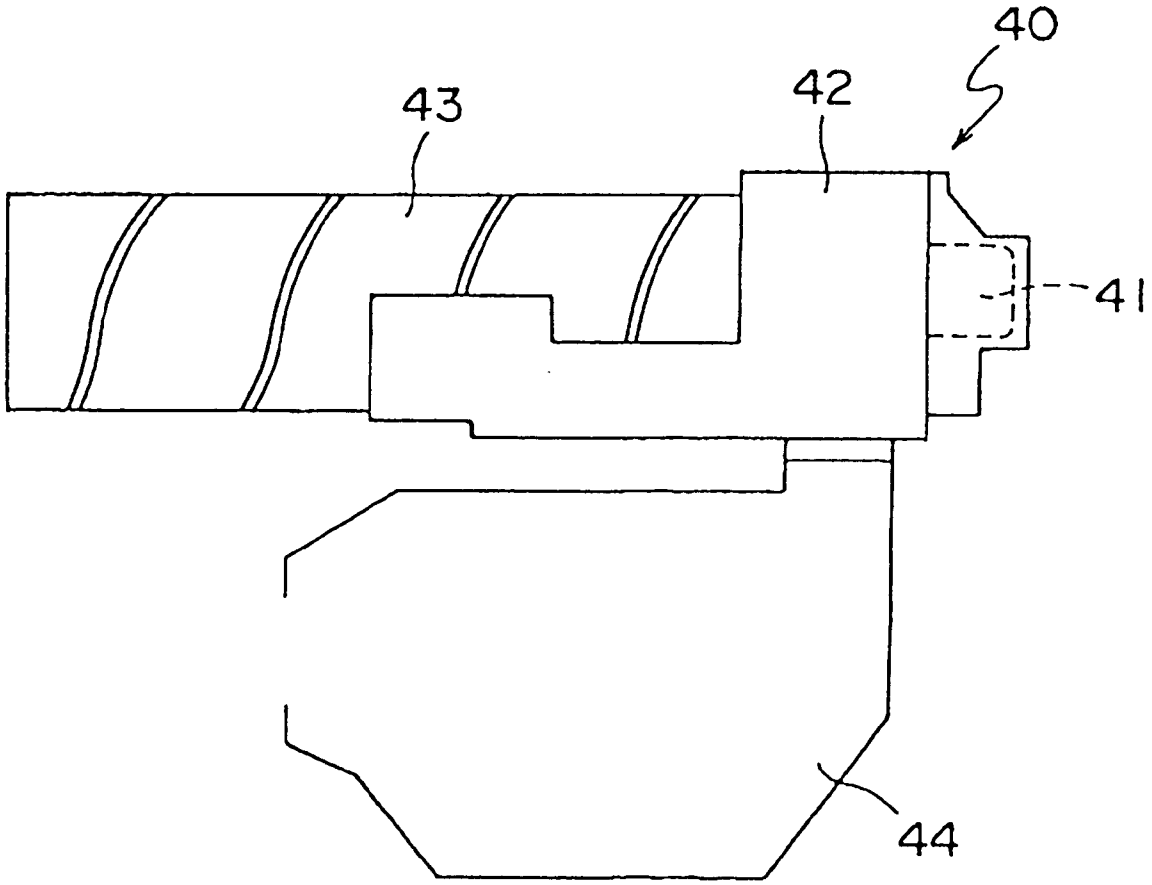
FIG. 2 is a drawing showing a developer unit.

FIG. 2 shows developer unit 40. Developer unit 40 has supply device 42 equipped with toner supply motor 41, such that the toner inside toner bottle 43 attached to supply device 42 may be supplied to developing member 44 based on the drive of toner supply motor 41.

In copying machine 1 pertaining to the present invention, after a malfunction is detected, the control of the unit including the device in which the malfunction has occurred is carried out while isolating the malfunctioning device from said control, while the malfunction is still present, so that the copying operation can be performed. Devices in which said malfunction may occur and units that include said devices, as well as the control regarding said units, will be explained below.

In this embodiment, optical unit 20, photoreceptor unit 30, developer unit 40, fusing unit 60 and power supply unit 80 are the units to which the isolation control is applied under a prescribed condition, and devices in which a malfunction may be detected are the devices that comprise each of units 20, 30, 40, 60 and 80. Specifically, devices in which a malfunction may be detected include optical member cooling fan motor 21 of optical unit 20, main eraser lamp 31 and charge wire cleaning motor 32 of photoreceptor unit 30, toner supply motor 41, developing member cooling fan motor 45 and pretransfer eraser lamp 46 of developer unit 40, fuser cooling fan motor 61 of fusing unit 60, and transformer cooling fan motor 81 of power supply unit 80.

Units for which the isolation control is performed regardless of whether or not a prescribed condition exists are paper feeding unit 50 and two-sided copy unit 90. Devices of these units in which a malfunction may be detected are the paper feed motors (not shown in the drawings) for the paper cassettes and the paper feed motor (not shown in the drawings) for the two-sided copy unit.

The details regarding the control regarding units 20, 30, 40, 60 or 80 when a malfunction occurs in devices 21, 31, 32, 41, 45, 46, 61 or 81 in which a malfunction may be detected will be explained below.

[Optical member cooling fan motor 21]

Optical member cooling fan motor 21 drives the fan that cools the platen glass of optical unit 20. Even if a malfunction occurs in this optical member cooling fan motor 21, copying can take place so long as the temperature of the platen glass is at or below a prescribed level. Therefore, where optical member cooling fan motor 21 suffers a malfunction, the control of optical unit 20 is performed while isolating the control for optical member cooling fan motor 21 from said control. This enables the copying operation to continue. Thereafter, when the temperature of the platen glass measured by temperature sensor 22 that measures said temperature exceeds a prescribed level, the control for optical unit 20 is stopped, whereupon the copying operation is suspended and subsequent copying operations are prohibited. It is also acceptable if optical unit 20 is stopped and further copying operations are prohibited based on, instead of the platen glass temperature, information such as the number of continuous copies made, the continuous copying time elapsed, the cumulative total number of copies made or the cumulative copying time elapsed.

[Main eraser lamp 31 and charge wire cleaning motor 32]

Where either main eraser lamp 31 or charge wire cleaning motor 32 experiences a malfunction, or both of them have a malfunction at the same time, the image quality of the copied image does not deteriorate immediately. Therefore, where a malfunction occurs in main eraser lamp 31 or charge wire cleaning motor 32, or in both of them, the control of photoreceptor unit 30 is performed while isolating the control for the malfunctioning main eraser lamp 31 or charge wire cleaning motor 32, or the control for both of them, from said control. This enables the copying operation to continue. Photoreceptor unit 30 is then stopped when the number of continuous copies made, the continuous copying time elapsed, the cumulative number of copies made or the cumulative copying time elapsed exceeds a prescribed level, whereupon the copying operation is suspended and subsequent copying operations are prohibited.

[Toner supply motor 41, developing member cooling fan motor 45 and pre-transfer eraser lamp 46]

Toner supply motor 41 has a function to supply the toner inside toner bottle 43 to developing member 44 to maintain the toner concentration at a prescribed level. Even if a malfunction occurs in toner supply motor 41, an image of the desired darkness may be formed after the occurrence of said malfunction so long as there is toner remaining inside developing member 44. Therefore, where a malfunction occurs in toner supply motor 41, the control of developer unit 40 is performed while isolating the control for toner supply motor 41 from said control. This enables the copying operation to continue. Thereafter, when the toner concentration measured by toner concentration sensor 47 falls to a prescribed level or lower, developer unit 40 is stopped, whereupon the copying operation is suspended and subsequent copying operations are prohibited.

Developing member cooling fan motor 45 drives the fan that cools developer unit 40. Even if a malfunction occurs in this developing member cooling fan motor 45, copying is possible so long as the temperature of developer unit 40 is at or below a prescribed level. Therefore, where a malfunction occurs in developing member cooling fan motor 45, control of developer unit 40 is carried out wile isolating the control for developing member cooling fan motor 45 from said control. This enables the copying operation to continue. Thereafter, when the temperature of developer unit 40 measured by temperature sensor 48 that measures said temperature exceeds a prescribed level, developer unit 40 is stopped, whereupon the copying operation is suspended and subsequent copying operations are prohibited.

Pre-transfer eraser lamp 46 is mounted in order to prevent transfer malfunctions with regard to the top end of the sheet when lightweight, easily deformed sheets of paper are used in a copying machine employing the AC charger separation method. Therefore, even if a malfunction occurs in pre-transfer eraser lamp 46, the control of developer unit 40 is carried out wile isolating the control for pre-transfer eraser lamp 46 from said control. This enables the copying operation to continue. When this is done, it is acceptable if the use of lightweight, easily deformed sheets is also prohibited. Thereafter, based on information regarding the number of continuous copies made, the continuous copying time elapsed, the cumulative number of copies made or the cumulative copying time elapsed, developer unit 40 is stopped, whereupon the copying operation is suspended and subsequent copying operations are prohibited.

[Fuser cooling fan motor 61]

Fuser cooling fan motor 61 drives the fan that cools fusing unit 60. Even if a malfunction occurs in this fuser cooling fan motor 61, copying can be carried out so long as the temperature of fusing unit 60 is at or below a prescribed level. Therefore, where a malfunction occurs in fuser cooling fan motor 61, the control of fusing unit 60 is performed wile isolating the control for fuser cooling fan motor 61 from said control. This enables the copying operation to continue. Thereafter, when the temperature of fusing unit 60 measured by temperature sensor 64 that measures said temperature exceeds a prescribed level, fusing unit 60 is stopped, whereupon the copying operation is suspended and subsequent copying operations are prohibited.

[Transformer cooling fan motor 81]

Transformer cooling fan motor 81 drives the fan that cools power supply unit 80. Where a malfunction occurs in this transformer cooling fan motor 81, copying may be performed so long as the temperature of power supply unit 80 is at or below a prescribed level. Therefore, where a malfunction occurs in transformer cooling fan motor 81, the control of power supply unit 80 is performed while isolating the control for transformer cooling fan motor 81 from said control. This enables the copying operation to continue. Thereafter, when the temperature of power supply unit 80 measured by temperature sensor 84 that measures said temperature exceeds a prescribed level, power supply unit 80 is stopped, whereupon the copying operation is suspended and subsequent copying operations are prohibited.

In the examples of control for the various units explained above, copying operations are prohibited when a certain condition exists. Instead, however, it is also acceptable if a maintenance call that urges the user to contact a service person is displayed on panel switch display member 115, or if the prohibition of copying operations and the displaying of a maintenance call take place simultaneously.

Figure 3:
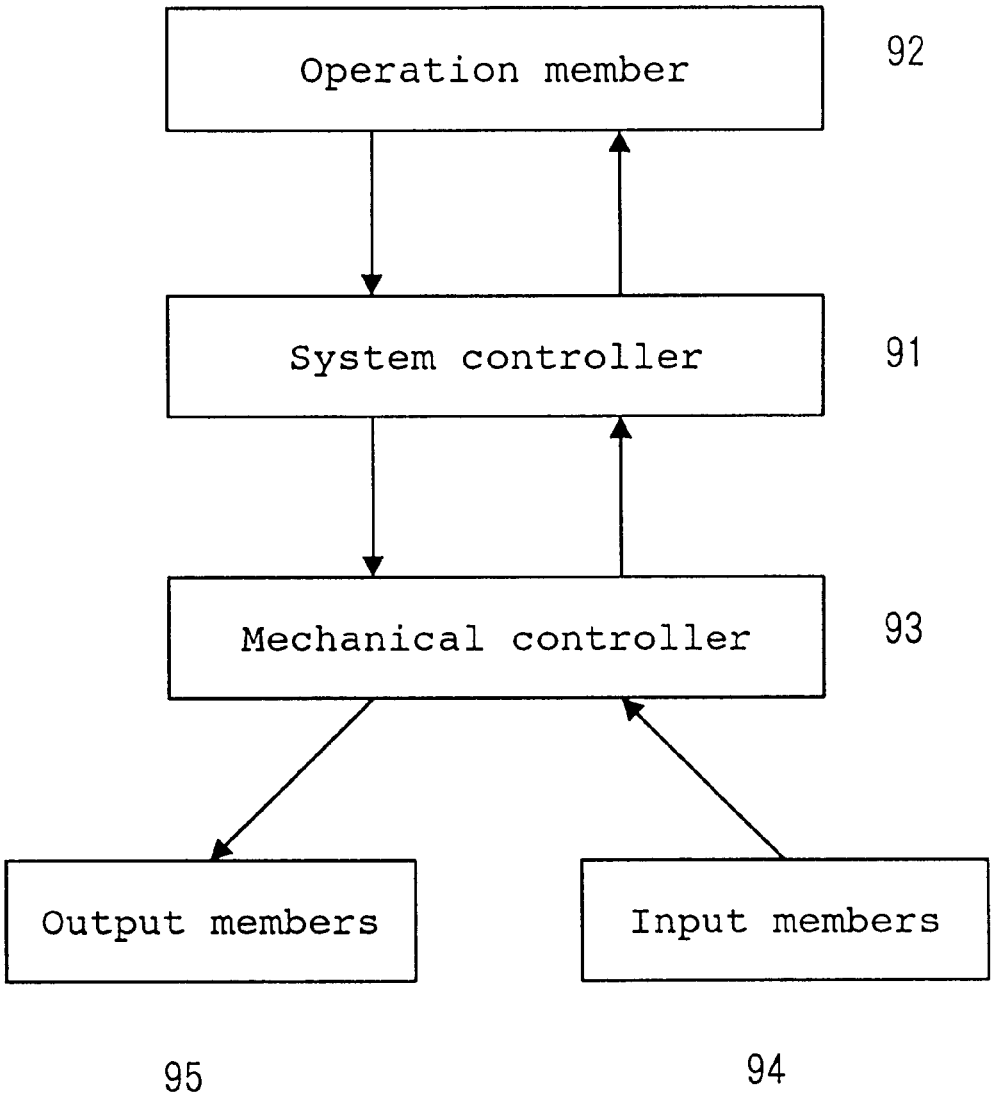
FIG. 3 is a drawing representing a control block that controls the entire system of the copying machine pertaining to the present invention.
Figure 4:
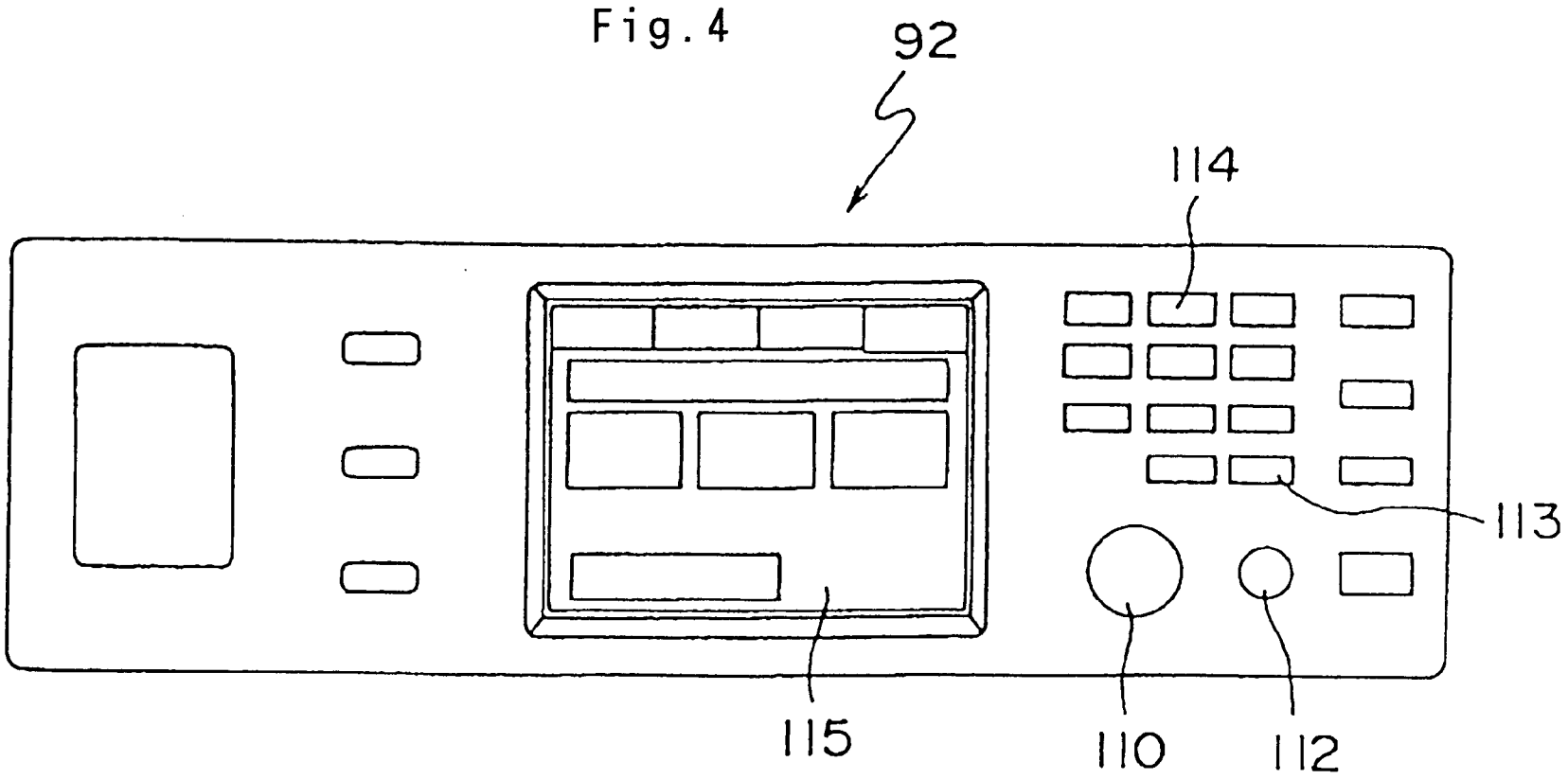
FIG. 4 is a plan view of an operation unit.

The control block that controls the entire system of copying machine 1 will now be explained. FIG. 3 is a diagram regarding the control block that controls the entire system of copying machine 1. System controller 91 controls the entire system. Operation member 92 is used for operation input for copying machine 1 and displays operation parameters, warnings, etc. It is equipped with start key 110 that starts a copying operation, stop key 112 that stops a copying operation, clear key 113 that deletes the set parameters, numeric keypad 114 that is used to set the number of copies, etc., and panel switch display member 115 that displays control details, etc.

Mechanical controller 93 directly controls said units 20, 30, 40, 50, 60, 70, 80 and 90, and is connected to input members 94 of the sensors and output members 95 of the motors for these units. Mechanical controller 93 detects malfunctions in devices 21, 31, 32, 41, 45, 46, 61 or 81, as well as in the paper feed motors, based on an input signal from input member 94. When a malfunction is detected, mechanical controller 93 transmits a signal indicating a malfunction to system controller 91.

The isolation control of the present invention will now be explained with reference to the flow charts of FIGS. 5 and 6.

Figure 5:
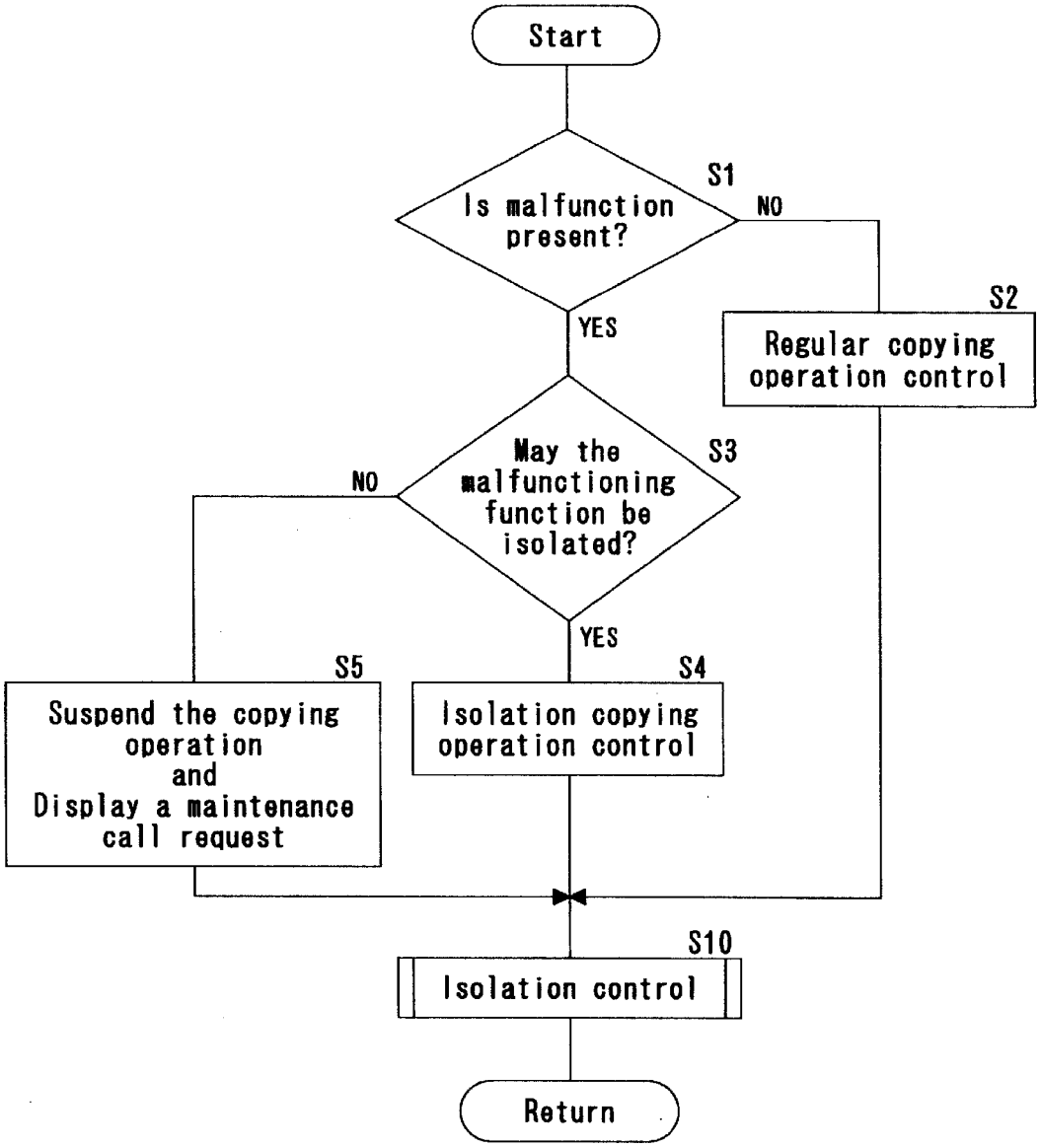
FIG. 5 is a flow chart for the isolation control regarding the copying machine pertaining to the present invention.

FIG. 5 is a flow chart regarding the isolation control.

When a signal is input from input member 94 to mechanical controller 93, said controller detects a malfunction and outputs a malfunction signal to system controller 91 via a serial communication line. System controller 91 determines whether or not a malfunction is present based on this malfunction signal (step S1). Where it is determined that a malfunction is not present, regular copying operation control procedures are carried out (step S2). Where it is determined that a malfunction is present, it is further determined whether the malfunction has occurred in a device that may be isolated (i.e., devices 21, 31, 32, 41, 45, 46, 61 or 81 or one of the paper feed motors) (step S3).

Where it is determined in step S3 that the device cannot be isolated, the copying operation is immediately suspended and a maintenance call request is displayed in panel switch display member 115 (step S5). Where it is determined that the device may be isolated, the isolation copying operation control is carried out (step S4).

In the isolation copying operation control performed in step S4, the control of the unit including the malfunctioning device is performed while isolating said device from said control, and the entire copying operation is controlled by managing the controls of the various units. In other words, copying operation control is performed while making the malfunctioning device unusable. Therefore, the copying operation may be continued in this condition.

During isolation copying operation control, the fact that a malfunction has occurred is displayed on panel switch display member 115. When this is done, it is also acceptable if the details of the malfunction and the unavailability of a copying mode involving the malfunctioning device may be displayed as well. For example, if the paper feed motor for two-sided copy unit 90 experiences a malfunction, it is displayed that two-sided copying mode cannot be selected. The user can accurately recognize the malfunction present in copying machine 1 and continue copying operations without delay based on the information thus displayed.

Further, it is also acceptable if a control that reduces the burden on the machine due to the malfunction, said control being different from the regular control, or a control that substitutes another device for the malfunctioning device may be performed during the isolation copying operation control.

For example, where a malfunction is detected regarding optical member cooling fan 21, a control that increases the copying intervals and reduces the light emission duration per unit time period of the exposure lamp to reduce an increase in temperature is one possibility for a control that reduces the burden on the machine due to the malfunction. By performing this control, the time period before the copying operation is stopped may be prolonged when the isolation control is used.

Further, where toner concentration sensor 47 has a malfunction, for example, a control may be performed that isolates toner concentration sensor 47 from the control of developer unit 40 and performs control of developer unit 40 based on the information from the image density sensor instead, as a control that substitutes a different function for the malfunctioning function. In this case, toner concentration sensor 47 may be substituted for by creating a test pattern in the area between images on the photoreceptor for each copying operation and checking the darkness of this test pattern.

In step S10, the isolation control subroutine takes place. In this subroutine, it is determined whether or not a certain condition exists and whether or not the copying operation should be continued. The details regarding this subroutine are explained below with reference to FIG. 6.

Figure 6:
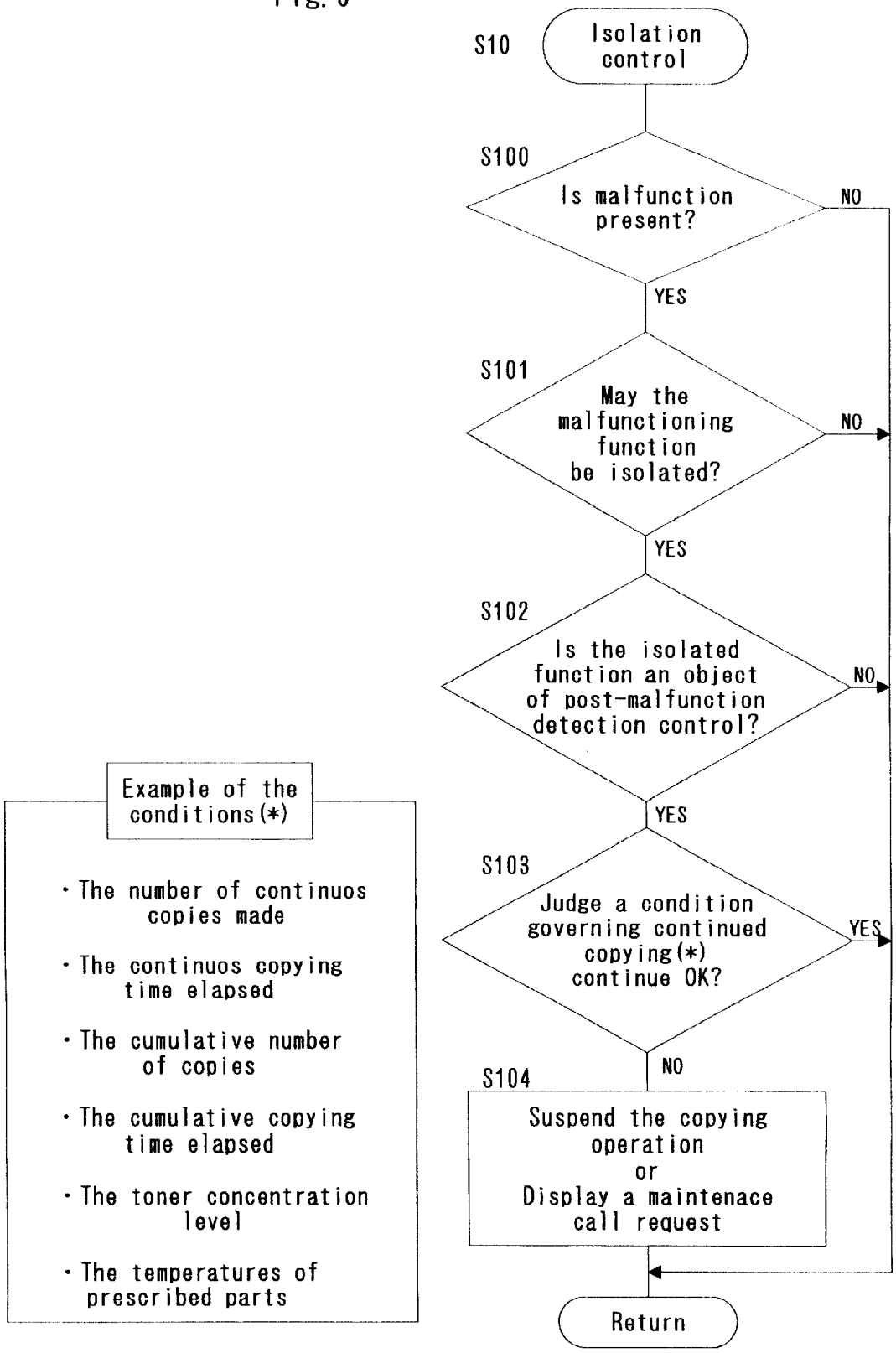
FIG. 6 is a flow chart showing the sequence regarding the condition for continued operation in the isolation control pertaining to the present invention.

FIG. 6 is a flow chart showing the step S10 subroutine in FIG. 5.

In steps S100 and S101, the same determinations take place as in steps S1 and S3 in FIG. 5. Where it is determined in step S101 that the function of the malfunctioning device may be isolated, it is then determined in step S102 that the isolated function is an object of post-malfunction detection control. If it is, i.e., where the function belongs to devices 21, 31, 32, 41, 45, 46, 61 or 81 of units 20, 30, 40, 60, 70 or 80, it is determined in step S103 whether or not any of conditions governing the continuation of the copying operation exist. Where the function of the malfunctioning device is not an object of said control, i.e., where it belongs to the paper feed motors of units 50 or 90, determination as to whether the copying operation should be continued does not take place.

In step S103, it is determined whether a condition governing continued copying exists when the isolated device is an object of this control. If said certain condition does not exist, the copying operation is allowed to continue. Where said certain condition does exist, the copying operation is suspended and subsequent copying operations are prohibited, or a maintenance call request is displayed on panel switch display member 115, urging the user to contact a service person (step S104). The conditions governing continued copying in step S103 involve the number of continuous copies made, the continuous copying time elapsed, the cumulative number of copies, the cumulative copying time elapsed, the toner concentration level and the temperatures of prescribed parts. Conditions are selected in response to the device that has malfunctioned.

For the method to stop the copying operation in step S104, the feeding of a new sheet of paper may be immediately halted in consideration of the effect on mechanical performance, or the operation of start key 110 may be prohibited after the completion of copying onto a set of sheets. In other words, the acceptance of the next image forming operation may be prohibited after the completion of a particular copy sequence. It is also acceptable if the conditions for continued copying are set in stages, so that a maintenance call request is displayed on panel switch display member 115 of operation member 92 in the first stage and the copying operation is stopped in the second stage.

Copying machine 1 was used as an example of an image forming apparatus in the explanation of this embodiment, but, in addition to copying machine 1, it is also acceptable if the image forming apparatus is a printer or facsimile machine.

As is clear from the explanation provided above, in the image forming apparatus pertaining to the present invention, the operation rate may be increased relative to that of a conventional image forming apparatus because, when a malfunction occurs, the image forming operation is prohibited if a condition that is related to the function of the device that malfunctioned and that affects the image forming function exists while the malfunction is still present.

Although the present invention has been fully described by way of examples with reference to the accompanying drawings, it is to be noted that various changes and modification will be apparent to those skilled in the art. Therefore, unless otherwise stated that such changes and modifications depart from the scope of the present invention, they should be construed as being included therein.

What is claimed is:

1. An image forming apparatus, comprising:

a detector which detects malfunctions in devices contained in the image forming apparatus;

a first control means for permitting an image forming operation without using a device which is detected to have a malfunction by said detector;

a condition determining means for determining whether or not a prescribed condition exists after the detection of the malfunction; and a warning means for warning of an abnormal condition of the image forming apparatus when it is determined by said condition determining means that said prescribed condition exists.

2. An image forming apparatus as claimed in claim 1, wherein said warning means warns of the abnormal condition by prohibiting the image forming operation.

3. An image forming apparatus as claimed in claim 1, wherein said warning means warns of the abnormal condition by displaying prescribed information.

4. An image forming apparatus as claimed in claim 1, wherein said prescribed condition is a condition that affects the image forming operation in connection with a function of the device detected to have the malfunction by said detector.

5. An image forming apparatus as claimed in claim 4, wherein said prescribed condition is a condition based on the number of continuous images formed or the continuous image forming time elapsed.

6. An image forming apparatus as claimed in claim 4, wherein said prescribed condition is a condition based on the cumulative number of images or the cumulative image forming time elapsed.

7. An image forming apparatus as claimed in claim 4, wherein said prescribed condition is a condition based on a toner concentration level.

8. An image forming apparatus as claimed in claim 4, wherein said prescribed condition is a condition based on the temperature of prescribed parts.

9. An image forming apparatus as claimed in claim 1, which has a plurality of units each unit including at least one of said devices, said first control means controlling the unit without using a device detected to have the malfunction by said detector so as to permit the image forming operation.

10. An image forming apparatus as claimed in claim 1, further comprising:

a display which displays a prescribed message when the malfunction is detected by said detector.

11. An image forming apparatus as claimed in claim 1, further comprising:

a second control means for controlling an another device instead of the device detected to have the malfunction by said detector, wherein said another device performs the same function as the device detected to have the malfunction.

12. An image forming apparatus as claimed in claim 11, wherein said device detected to have the malfunction includes a toner concentration sensor for measuring a toner concentration in the developer unit, said another device includes an image density sensor for measuring the density of an image pattern, and said same function is a function of controlling the toner concentration such that the toner concentration is maintained uniformly.

13. An image forming apparatus as claimed in claim 1, further comprising:

a third control means for performing a control that reduces the burden on the image forming apparatus due to a function of the device detected to have the malfunction by said detector.

14. An image forming apparatus as claimed in claim 13, wherein said device detected to have the malfunction includes an optical member cooling fan, said third control means performing a control that increases image forming intervals.

15. An image forming apparatus as claimed in claim 1, further comprising:

a judging means for judging whether or not the device detected to have the malfunction is an object of a control after the detection of the malfunction by said detector, said condition determining means determining the condition when said judging means has judged that the device is said object.

16. An image forming apparatus as claimed in claim 1, wherein said warning means warns of an abnormal condition by prohibiting the next image forming operation after the completion of the current image forming operation.

17. An image forming apparatus as claimed in claim 1, wherein said device detected to have the malfunction includes a cooling fan motor.

18. An image forming apparatus as claimed in claim 1, wherein said device detected to have the malfunction includes an eraser lamp.

19. An image forming apparatus as claimed in claim 1, wherein said device detected to have the malfunction includes a charge wire cleaning motor.

20. An image forming apparatus as claimed in claim 1, wherein said device detected to have the malfunction includes a toner supply motor.

21. An image forming apparatus control method, comprising the steps of:

detecting a malfunction in any of devices that are contained in the image forming apparatus;

permitting performance of an image forming operation when the malfunction is detected by isolating the device detected to have the malfunction from the control;

determining whether or not a prescribed condition exists after the malfunction is detected;

and warning of an abnormal condition of the image forming apparatus when it is determined that said prescribed condition exists.

22. An image forming apparatus control method as claimed in claim 21, which warns of the abnormal condition by prohibiting the image forming operation.

23. An image forming apparatus control method as claimed in claim 21, which warns of the abnormal condition by displaying prescribed information.

24. An image forming apparatus control method as claimed in claim 21, wherein said prescribed condition is a condition that affects the image forming operation in connection with the function of the device detected to have the malfunction.

25. An image forming apparatus control method as claimed in claim 24, wherein said prescribed condition is a condition based on the number of continuous image forming operations or the continuous image forming time elapsed.

26. An image forming apparatus control method as claimed in claim 24, wherein said prescribed condition is a condition based on the cumulative number of images formed or the cumulative image forming time elapsed.

27. An image forming apparatus control method as claimed in claim 24, wherein said prescribed condition is a condition based on a toner concentration level.

28. An image forming apparatus control method as claimed in claim 24, wherein said prescribed condition is a condition based on the temperature of prescribed parts.

29. An image forming apparatus control method as claimed in claim 21, wherein said image forming apparatus has a plurality of units each unit including at least one of said devices, further comprising the step of controlling a unit without using the device detected to have the malfunction so as to permit the image forming operation.

30. An image forming apparatus control method as claimed in claim 21, further comprising the step of:

displaying a prescribed message when the malfunction is detected.

31. An image forming apparatus control method as claimed in claim 21, further comprising the step of:

controlling an another device instead of the device detected to have the malfunction by said detector, wherein said another device performs the same function as the device detected to have the malfunction.

32. An image forming apparatus control method as claimed in claim 21, further comprising the step of:

performing a control that reduces the burden on the image forming apparatus due to a function of the device detected to have the malfunction by said detector.

33. An image forming apparatus control method as claimed in claim 21, further comprising the step of:

judging whether or not the device detected to have the malfunction is an object of a control after the detection of the malfunction, and determining the condition when said judging means judged that the device is said object.

34. An image forming apparatus, comprising:

a detector which detects malfunctions in devices that comprise the image forming apparatus;

a selector which selects one from a first control or a second control based on the device detected to have the malfunction by said detector, said first control is that prohibiting the image forming operation when the malfunction is detected, said second control is that permitting the image forming operation without using the device detected to have the malfunction; and a controller which determines whether or not a prescribed condition exists during said second control, warning of an abnormal condition of the image forming apparatus when it is determined that said prescribed condition exists.

35. An image forming apparatus as claimed in claim 34, wherein said prescribed condition is a condition that affects the image forming operation in connection with the function of the device detected to have the malfunction.

36. A control method of an apparatus during malfunction, comprising the steps of:

detecting a malfunction in any of devices that are contained in the apparatus;

permitting performance of the operation when the malfunction is detected on the condition that isolating the device detected to have the malfunction from the control;

determining whether or not a prescribed condition exists after the malfunction is detected; and warning of an abnormal condition of the apparatus when it is determined that said prescribed condition exists.

* * * * *